US012571142B2

(12) United States Patent
Matsuda et al.

(10) Patent No.: US 12,571,142 B2
(45) Date of Patent: Mar. 10, 2026

(54) SHEET MANUFACTURING APPARATUS

(71) Applicant: SEIKO EPSON CORPORATION, Tokyo (JP)

(72) Inventors: Kensaku Matsuda, Matsumoto (JP); Toshizo Nishi, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 111 days.

(21) Appl. No.: 18/774,994

(22) Filed: Jul. 17, 2024

(65) Prior Publication Data

US 2025/0027240 A1 Jan. 23, 2025

(30) Foreign Application Priority Data

Jul. 19, 2023 (JP) ..... 2023-117355

(51) Int. Cl.

| | |
|---|---|
| ***D21F 9/00*** | (2006.01) |
| ***D04H 1/425*** | (2012.01) |
| ***D04H 1/44*** | (2006.01) |
| ***D04H 1/732*** | (2012.01) |

(52) U.S. Cl.

CPC ..... *D04H 1/732* (2013.01); *D04H 1/425* (2013.01); *D04H 1/44* (2013.01); *D21F 9/00* (2013.01)

(58) Field of Classification Search

CPC ..... D21B 1/063; D21B 1/066; B65B 43/08; B31D 1/005; D21J 3/12

See application file for complete search history.

(56) References Cited

U.S. PATENT DOCUMENTS

| | | | | |
|---|---|---|---|---|
| 7,134,859 | B1 * | 11/2006 | Sorensen | D21D 1/32 425/83.1 |
| 2015/0090416 | A1 * | 4/2015 | Nakamura | D21D 99/00 162/263 |
| 2019/0203415 | A1 * | 7/2019 | Yoshioka | D21B 1/08 |
| 2020/0246837 | A1 | 8/2020 | Inagaki et al. | |
| 2020/0385924 | A1 * | 12/2020 | Aoyama | D21F 1/00 |
| 2023/0034767 | A1 | 2/2023 | Omagari | |

FOREIGN PATENT DOCUMENTS

| | | |
|---|---|---|
| JP | 2020-121294 A | 8/2020 |
| JP | 2023-018829 A | 2/2023 |

* cited by examiner

*Primary Examiner* — Yung-Sheng M Tsui
*Assistant Examiner* — Melody Tsui
(74) *Attorney, Agent, or Firm* — Spencer Fane LLP

(57) ABSTRACT

A sheet manufacturing apparatus includes a defibrator that includes a defibrating blade and a discharge duct, defibrates a material with the defibrating blade, and discharges a defibrated material containing a fiber from the discharge duct, a separator that includes an introduction duct and a separation filter, receives the defibrated material from the introduction duct, and separates and extracts the fiber from the defibrated material with the separation filter, an accumulation unit that causes the fiber supplied from the separator to accumulate to form a web, and a forming unit that compresses the web to form a sheet, and the separator is disposed directly below the defibrator, and a leading end of the introduction duct is disposed to face a leading end of the discharge duct.

5 Claims, 14 Drawing Sheets

SHEET MANUFACTURING APPARATUS

The present application is based on, and claims priority from JP Application Serial Number 2023-117355, filed Jul. 19, 2023, the disclosure of which is hereby incorporated by reference herein in its entirety.

BACKGROUND

1. Technical Field

The present disclosure relates to a sheet manufacturing apparatus.

2. Related Art

In the related art, an apparatus for manufacturing a sheet or the like by using fibers obtained by defibrating used paper or the like has been known. Such apparatuses may be provided with a separation mechanism for sorting defibrated fibers from unnecessary components. For example, JP-A-2023-18829 discloses a fiber body manufacturing apparatus including a defibrating device and a sorting unit. In addition, JP-A-2020-121294 discloses a fiber body accumulation apparatus including a defibrating unit and a separation device.

However, in the apparatuses described in JP-A-2023-18829 and JP-A-2020-121294, there is a problem in which fibers and the like are easily retained between the defibrating mechanism and the separation mechanism. Specifically, since the defibrating mechanism has a rotary member, vibration is likely to occur during the operation. In order to suppress propagation of the above-described vibration to the separation mechanism, the defibrating mechanism and the separation mechanism are generally coupled by a flexible pipe. In this case, a step is likely to be formed in an internal path in a coupling portion between the defibrating mechanism and the flexible pipe, a coupling portion between the flexible pipe and the separation mechanism, or the like. There is a possibility that fibers or the like are retained around such a step. Retention of fibers makes a supply state of fibers unstable and may cause deterioration in quality of a manufactured sheet. That is, there is a need for a sheet manufacturing apparatus that suppresses retention of fibers between the defibrating mechanism and the separation mechanism.

SUMMARY

A sheet manufacturing apparatus that manufactures a sheet from a material containing a fiber includes a defibrator that includes a defibrating blade and a discharge duct, defibrates the material with the defibrating blade, and discharges a defibrated material containing the fiber from the discharge duct, a disk separator that includes an introduction duct and a separation filter, receives the defibrated material from the introduction duct, and separates and extracts the fiber from the defibrated material with the separation filter, an accumulation unit that causes the fiber supplied from the separator to accumulate by an airflow to form a web, and a sheet forming unit that compresses the web to form the sheet, and the separator is disposed directly below the defibrator, and a leading end of the introduction duct of the separator is disposed to face a leading end of the discharge duct of the defibrator.

BRIEF DESCRIPTION OF THE DRAWINGS

FIG. 5 is a perspective view illustrating an appearance of a rotary blade and the like.

DESCRIPTION OF EMBODIMENTS

In the following embodiment, as a sheet manufacturing apparatus that manufactures a sheet from a material containing fibers, a sheet manufacturing apparatus 1 that regenerates paper pieces such as used paper by a dry type method will be exemplified and described with reference to the drawings. The sheet manufacturing apparatus of the present disclosure is not limited to a dry type, and may be a wet type. In the present specification, "dry type" means not to be performed in a liquid but to be performed in air such as the atmosphere.

In each of the following drawings, XYZ axes are given as coordinate axes orthogonal to each other, a direction indicated by each arrow is set as a positive direction, and a direction opposite to the positive direction is set as a negative direction. The Z axis is a virtual axis extending in a vertical direction, a +Z direction is an upward direction, and a −Z direction is a downward direction. The −Z direction is a direction in which gravity acts. In addition, in the sheet manufacturing apparatus 1, a leading side in a transport direction of a raw material, a web, a sheet, and the like may be referred to as downstream, and a going-back side in the transport direction may be referred to as upstream. For convenience of illustration, the size of each member is different from the actual size.

Figure 1:
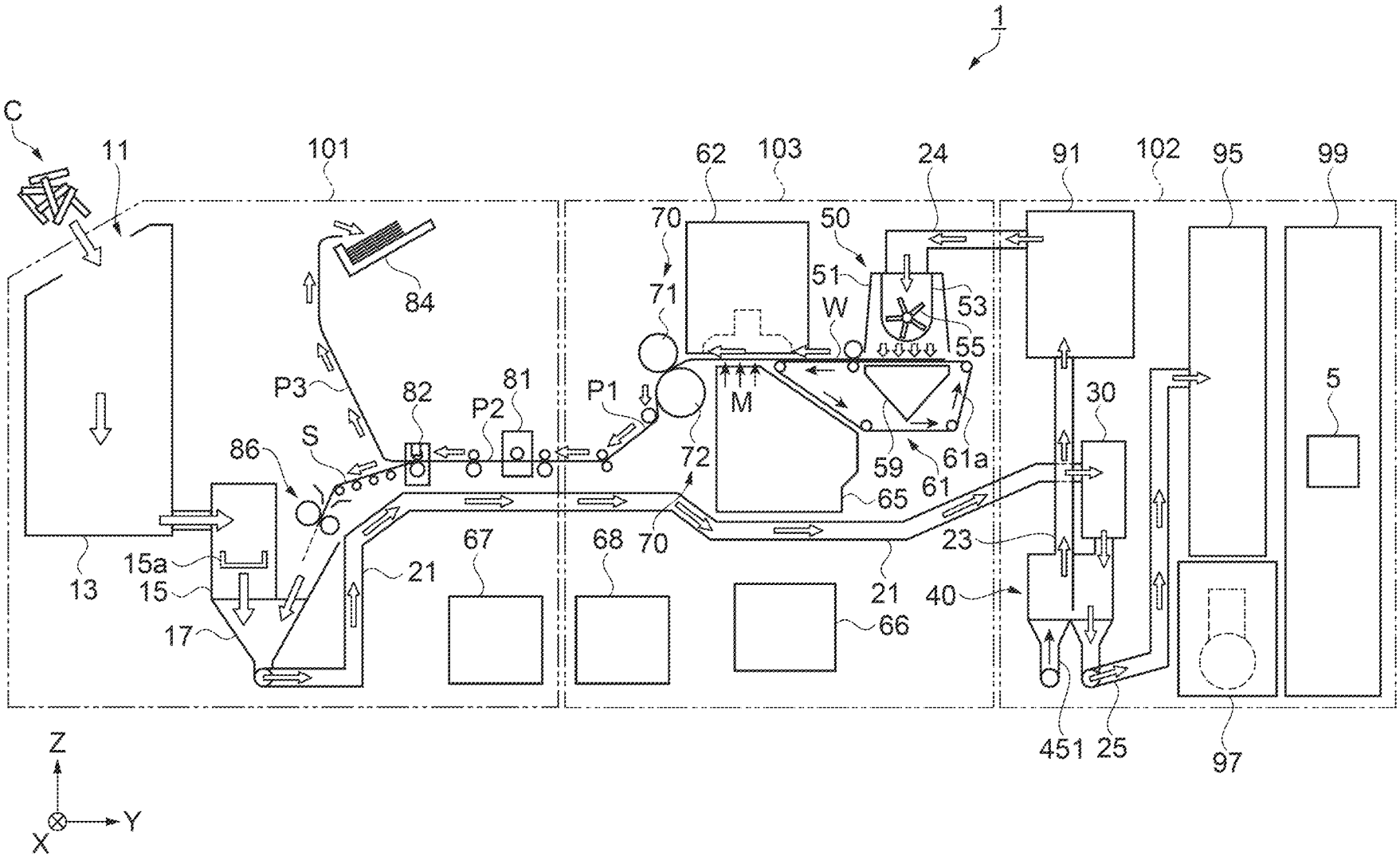
FIG. 1 is a schematic diagram illustrating a configuration of a sheet manufacturing apparatus according to an embodiment.

As illustrated in FIG. 1, the sheet manufacturing apparatus 1 according to the present embodiment includes a first unit group 101, a second unit group 102, and a third unit group 103. The first unit group 101, the second unit group 102, and the third unit group 103 are supported by a frame (not illustrated). In FIG. 1, directions in which used paper C, a sheet P3, a slit piece S, an unnecessary scrap, and the like move are indicated by white arrows.

The sheet manufacturing apparatus 1 manufactures the sheet P3 from the used paper C, which is a material containing fibers. In the sheet manufacturing apparatus 1, the first unit group 101, the third unit group 103, and the second unit group 102 are arranged from a −Y direction to a +Y direction in a side view in a −X direction.

The used paper C is transported from the first unit group 101 to the second unit group 102 through a pipe 21 crossing inside the third unit group 103. Then, the used paper C is subjected to defibration or the like in the second unit group 102 to become fibers and then becomes a mixture containing a binding material or the like. The mixture is transported to the third unit group 103 through a pipe 24. The mixture is formed into a web W in the third unit group 103 and then formed into a strip-shaped sheet P1. The strip-shaped sheet P1 is cut into the sheet P3 in the first unit group 101.

The first unit group 101 includes a buffer tank 13, a fixed-quantity supply unit 15, a merging unit 17, and the pipe 21. In the first unit group 101, these components are arranged in this order from upstream to downstream. In addition, the first unit group 101 also includes a first cutting unit 81, a second cutting unit 82, a tray 84, and a shredding unit 86. The first cutting unit 81 and the second cutting unit 82 cut the strip-shaped sheet P1 into the sheet P3 having a predetermined shape. Further, the first unit group 101 includes a water supply unit 67. The water supply unit 67 is a water storage tank. The water supply unit 67 supplies water for humidification to each of a first humidification unit 65 and a second humidification unit 66, which will be described later, through a water supply pipe (not illustrated).

The used paper C is input from a raw material input port 11 to the buffer tank 13. The used paper C contains fibers such as cellulose, and is, for example, a piece of shredded used paper. Humidified air is supplied to an inside of the buffer tank 13 from the second humidification unit 66 provided in the third unit group 103.

The used paper C to be defibrated is temporarily stored in the buffer tank 13 and then transported to the fixed-quantity supply unit 15 according to the operation of the sheet manufacturing apparatus 1. The sheet manufacturing apparatus 1 may include a shredder for shredding the used paper C or the like upstream of the buffer tank 13.

The fixed-quantity supply unit 15 includes a measuring device 15*a* and a supply mechanism (not illustrated). The measuring device 15*a* weighs the mass of the used paper C. The supply mechanism supplies the used paper C weighed by the measuring device 15*a* to the downstream merging unit 17. That is, the fixed-quantity supply unit 15 weighs the used paper C for each predetermined mass by the measuring device 15*a*, and supplies the used paper C to the downstream merging unit 17 by the supply mechanism.

Both a digital measuring mechanism and an analog measuring mechanism can be applied to the measuring device 15*a*. Specific examples of the measuring device 15*a* include a physical sensor such as a load cell, a spring scale, and a balance. In the present embodiment, a load cell is used as the measuring device 15*a*. The predetermined mass for which the used paper C is weighed by the measuring device 15*a* is, for example, approximately several grams to several tens of grams.

A known technique such as a vibration feeder can be applied to the supply mechanism. The supply mechanism may be included in the measuring device 15*a*.

The weighing and supply of the used paper C in the fixed-quantity supply unit 15 is batch processing. That is, the supply of the used paper C from the fixed-quantity supply unit 15 to the merging unit 17 is intermittently performed. The fixed-quantity supply unit 15 may include a plurality of measuring devices 15*a*, and the plurality of measuring devices 15*a* may be operated at different times to improve the weighing efficiency.

In the merging unit 17, shredded pieces of the slit piece S supplied from the shredding unit 86 are merged and mixed with the used paper C supplied from the fixed-quantity supply unit 15. The slit piece S and the shredding unit 86 will be described later. The used paper C mixed with the above-described shredded pieces flows into the pipe 21 from the merging unit 17.

The pipe 21 transports the used paper C from the first unit group 101 to the second unit group 102 by an airflow generated by a blower (not illustrated).

The second unit group 102 includes a defibrator 30 which is a dry type defibrator, a separator 40, a pipe 23, a mixing unit 91, and the pipe 24. In the second unit group 102, these components are arranged in this order from upstream to downstream. In addition, the second unit group 102 also includes a collection unit 95, a compressor 97, a power supply unit 99, and a pipe 25 and an airflow pipe 451 that are coupled to the separator 40.

The used paper C transported through the pipe 21 flows into the defibrator 30. The defibrator 30 defibrates the used paper C supplied from the fixed-quantity supply unit 15 into fibers by a dry type method. A known defibrating mechanism can be applied to the defibrator 30. Entangled fibers included in paper pieces of the used paper C are untangled by the defibrator 30 to form a defibrated material containing fibers, and the defibrated material is transported to the separator 40. Details of the defibrator 30 will be described later.

The separator 40 separates the defibrated fibers. Specifically, the separator 40 removes components that are contained in the fibers and are unnecessary for manufacturing the sheet P3. That is, the separator 40 separates relatively long fibers from relatively short fibers. Since relatively short fibers may cause a decrease in strength of the sheet P3, the fibers are sorted out and removed by the separator 40. The separator 40 also removes coloring materials and additives contained in the used paper C. The separator 40 is of a disk type. Details of the separator 40 will be described later.

Humidified air is supplied into the separator 40 from the second humidification unit 66 of the third unit group 103.

Relatively short fibers and the like are removed from the defibrated fibers, and the defibrated fibers are transported to the mixing unit 91 through the pipe 23 by an airflow generated by a blower (not illustrated) disposed at a leading end of the airflow pipe 451. Unnecessary components such as relatively short fibers and coloring materials are discharged from the pipe 25 to the collection unit 95.

The mixing unit 91 mixes the fibers with a binding material or the like in the air to form a mixture. Although not illustrated, the mixing unit 91 includes a flow path through which the fibers are transported, a fan, a hopper, a supply pipe, and a valve.

The hopper is in communication with the flow path of the fibers via the supply pipe. The valve is provided in the supply pipe between the hopper and the flow path. The hopper supplies a binding material such as starch into the flow path. The valve adjusts the mass of the binding material supplied from the hopper to the flow path. As a result, the ratio at which the fibers and the binding material are mixed is adjusted.

In addition to the above-described components for supplying the binding material, the mixing unit 91 may include a similar component for supplying coloring materials, additives, or the like.

The fan of the mixing unit 91 mixes the binding material and the like in the air to form a mixture while transporting the fibers downstream by a generated airflow. The mixture flows into the pipe 24 from the mixing unit 91.

The collection unit 95 includes a filter (not illustrated). The filter filters out unnecessary components such as relatively short fibers transported through the pipe 25 by an airflow.

The compressor 97 generates compressed air. In the above-described filter, clogging may occur due to fine particles or the like of the unnecessary components. The filter can be cleaned by blowing compressed air generated by the compressor 97 onto the filter to blow off adhering particles.

The power supply unit 99 includes a control unit 5 and a power supply device (not illustrated) that supplies power to the sheet manufacturing apparatus 1. The power supply unit 99 distributes power supplied from an outside to each component of the sheet manufacturing apparatus 1. The control unit 5 is electrically coupled to each component of the sheet manufacturing apparatus 1 and integrally controls the operation of these components.

The third unit group 103 causes the mixture containing fibers to accumulate, compresses the mixture, and forms the mixture into the strip-shaped sheet P1 which is regenerated paper. The third unit group 103 includes an accumulation unit 50, a first transport unit 61, a second transport unit 62, the first humidification unit 65, the second humidification unit 66, a drainage unit 68, and a forming unit 70 which is a sheet forming unit.

In the third unit group 103, the accumulation unit 50, the first transport unit 61, the second transport unit 62, the first humidification unit 65, and the forming unit 70 are arranged in this order from upstream to downstream. The second humidification unit 66 is disposed below the first humidification unit 65.

The accumulation unit 50 forms the web W by causing the mixture containing fibers supplied from the separator 40 to accumulate using an airflow and gravity. The accumulation unit 50 includes a drum member 53, a blade member 55 installed in the drum member 53, a housing 51 that accommodates the drum member 53, and a suction unit 59. The mixture is taken into the drum member 53 from the pipe 24. The first transport unit 61 is disposed below the accumulation unit 50. The first transport unit 61 includes a mesh belt 61*a* and five tension rollers (not illustrated) for stretching the mesh belt 61*a*. The suction unit 59 faces the drum member 53 with the mesh belt 61*a* interposed therebetween in a direction along the Z axis.

The blade member 55 is disposed inside the drum member 53 and is rotationally driven by a motor (not illustrated). The drum member 53 is a semi-cylindrical sieve. A mesh having a function of a sieve is provided on a side surface of the drum member 53 facing downward. The drum member 53 allows particles such as fibers and mixtures smaller than the size of the openings of the mesh of the sieve to pass from an inside to an outside.

The mixture is discharged to the outside of the drum member 53 while being stirred by the rotating blade member 55 in the drum member 53. Humidified air is supplied from the second humidification unit 66 to the inside of the drum member 53.

The suction unit 59 is disposed below the drum member 53. The suction unit 59 sucks air in the housing 51 through a plurality of holes of the mesh belt 61*a*. As a result, an airflow for causing the mixture to accumulate on the mesh belt 61*a* is generated. The plurality of holes of the mesh belt 61*a* allow air to pass therethrough, but do not allow fibers, a binding material, and the like contained in the mixture to pass therethrough easily. As a result, the mixture discharged to the outside of the drum member 53 is sucked downward together with the air. The suction unit 59 is a known suction device such as a blower.

The mixture is dispersed in the air inside the housing 51 and accumulates on an upper surface of the mesh belt 61*a* by gravity and an airflow generated by the suction unit 59 to form the web W.

The mesh belt 61*a* is an endless belt and is stretched by the five tension rollers. The mesh belt 61*a* is rotated counterclockwise in FIG. 1 by rotation of the tension rollers. As a result, the mixture continuously accumulates on the mesh belt 61*a* to form the web W. The web W contains a relatively large amount of air and is soft and swollen. The first transport unit 61 transports the formed web W downstream by rotation of the mesh belt 61*a*.

The second transport unit 62 transports the web W in place of the first transport unit 61 downstream of the first transport unit 61. The second transport unit 62 peels the web W from the upper surface of the mesh belt 61*a* and transports the web W toward the forming unit 70. The second transport unit 62 is disposed above the transport path of the web W and slightly upstream of a starting point on a return side of the mesh belt 61*a*. The +Y direction of the second transport unit 62 and the −Y direction of the mesh belt 61*a* partially overlap in the vertical direction.

The second transport unit 62 includes a transport belt, a plurality of rollers, and a suction mechanism (that are not illustrated). The transport belt is provided with a plurality of holes through which air passes. The transport belt is stretched by the plurality of rollers and is rotated by rotation of the rollers.

The second transport unit 62 causes an upper surface of the web W to be sucked onto a lower surface of the transport belt by a negative pressure generated by the suction mechanism. When the transport belt rotates in this state, the web W is sucked onto the transport belt and transported downstream.

The first humidification unit 65 humidifies the web W containing fibers that is caused to accumulate by the accumulation unit 50 of the third unit group 103. Specifically, the first humidification unit 65 is, for example, a mist humidifier, and humidifies, by supplying mist M from below, the web W transported by the second transport unit 62. The first humidification unit 65 is disposed below the second transport unit 62 and faces, in the direction along the Z axis, the web W transported by the second transport unit 62. For example, a known humidifier such as an ultrasonic humidifier can be applied to the first humidification unit 65.

When the web W is humidified with the mist M, the function of starch as a binding material is promoted, and strength of the sheet P3 is improved. In addition, since the web W is humidified from below, falling of drops derived from mist onto the web W is suppressed. Further, since the web W is humidified from a side opposite to a contact surface between the transport belt and the web W, sticking of the web W onto the transport belt is reduced. The second transport unit 62 transports the web W to the forming unit 70.

The forming unit 70 includes processing rollers 71 and 72. The processing rollers 71 and 72 compress the web W containing fibers to form the strip-shaped sheet P1. The processing rollers 71 and 72 form a pair, each of which incorporates an electric heater and has a function of increasing a temperature of a roller surface.

Each of the processing rollers 71 and 72 is a substantially columnar member. A rotation axis of the processing roller 71 and a rotation axis of the processing roller 72 are arranged along the X axis. The processing roller 71 is disposed substantially above the transport path of the web W, and the processing roller 72 is disposed substantially below the transport path.

The processing roller 72 is rotationally driven by an actuator such as a stepping motor, for example. The processing roller 71 is a driven roller which is not driven by a motor or the like and is interlocked with rotation of the processing roller 72. The processing roller 71 rotates in a direction opposite to the direction in which the processing roller 72 rotates in a side view in a-X direction.

The web W is fed downstream while being pinched between the processing roller 71 and the processing roller 72, and heated and pressurized. That is, the web W continuously passes through the forming unit 70, and is press-formed while being heated. By using the processing rollers 71 and 72 as a pair of forming members, the web W can be efficiently heated and pressurized.

When the web W passes through the forming unit 70, the air contained in the web W is reduced from a soft state of the web W containing a relatively large amount of air, and the fibers of the web W are bonded to each other by the binding material whereby the web W is formed into the strip-shaped sheet P1. The strip-shaped sheet P1 is transported to the first unit group 101 by a transport roller (not illustrated).

The second humidification unit 66 is disposed below the first humidification unit 65. A known vaporization type humidifier can be applied to the second humidification unit 66. Examples of the vaporization type humidifier include a humidifier that generates humidified air by blowing air to a wetted nonwoven fabric or the like to vaporize moisture.

The second humidification unit 66 humidifies a predetermined region of the sheet manufacturing apparatus 1. The predetermined region is one or more of the buffer tank 13, the separator 40, and the inside of the drum member 53 of the accumulation unit 50. Specifically, the humidified air is supplied from the second humidification unit 66 to the above-described region via a plurality of pipes (not illustrated). The humidified air suppresses charging of the used paper C, fibers, and the like in each of the above-described components, and suppresses adhesion of the used paper C, fibers, and the like to members due to static electricity.

The drainage unit 68 is a drainage tank. The drainage unit 68 collects and stores old moisture that is used in the first humidification unit 65, the second humidification unit 66, and the like. The drainage unit 68 can be removed from the sheet manufacturing apparatus 1 as necessary, and the accumulated water can be discarded.

The strip-shaped sheet P1 transported to the first unit group 101 reaches the first cutting unit 81. The first cutting unit 81 cuts the strip-shaped sheet P1 in a direction intersecting with the transport direction, for example, in a direction along the X axis. The strip-shaped sheet P1 is cut into a single-cut sheet P2 by the first cutting unit 81. The single-cut sheet P2 is transported from the first cutting unit 81 to the second cutting unit 82.

The second cutting unit 82 cuts the single-cut sheet P2 in the transport direction, for example, in a direction along the Y axis. Specifically, the second cutting unit 82 cuts the single-cut sheet P2 in the vicinity of both sides in a direction along the X axis. As a result, the single-cut sheet P2 becomes the sheet P3 having a predetermined shape such as an A4 size or an A3 size.

When the single-cut sheet P2 is cut into the sheet P3 in the second cutting unit 82, the slit piece S, which is a scrap, is produced. The slit piece S is transported substantially in the −Y direction and reaches the shredding unit 86 which is a shredder. The shredding unit 86 shreds the slit piece S and supplies the slit piece S to the merging unit 17 as shredded pieces. A mechanism for weighing the shredded pieces of the slit piece S and supplying the shredded pieces to the merging unit 17 may be installed between the shredding unit 86 and the merging unit 17.

The sheet P3 is transported substantially upward and stacked on the tray 84. As described above, the sheet P3 is manufactured by the sheet manufacturing apparatus 1. The sheet P3 can be used as a substitute for, for example, copy paper.

Figure 2:
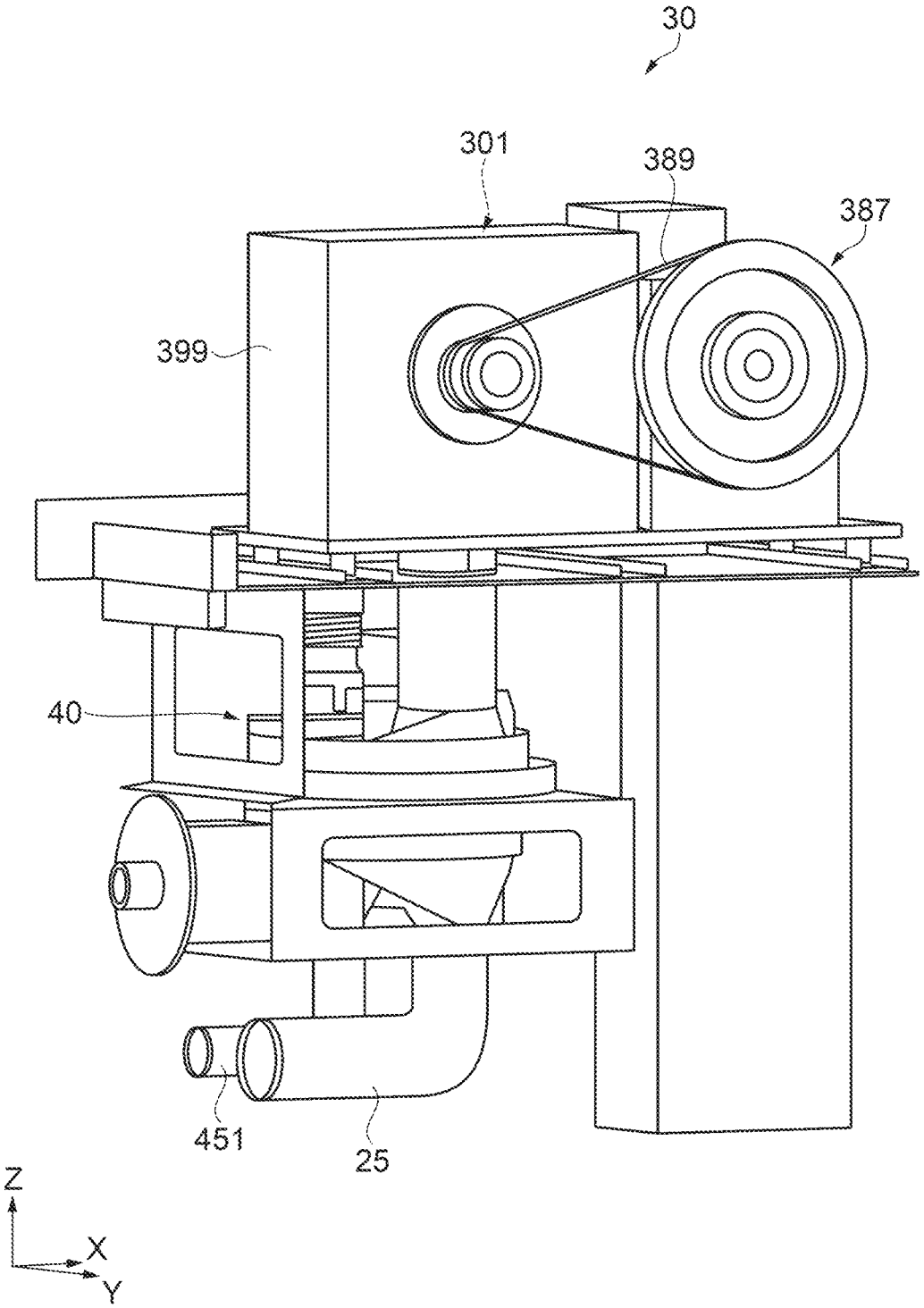
FIG. 2 is a perspective view illustrating an arrangement of a defibrator and a separator.

As illustrated in FIG. 2, the defibrator 30 and the separator 40 are aligned along the Z axis, and the separator 40 is disposed directly below the defibrator 30. In FIG. 2, components downstream of the pipe 25 and components on the above-described blower side of the airflow pipe 451 are not illustrated.

The defibrator 30 has a substantially rectangular parallelepiped exterior 399. A main body 301 of the defibrator 30 including a defibrating blade, which will be described later, and the like is accommodated in the exterior 399.

A drive unit 387 is provided in a +X direction of the exterior 399. The drive unit 387 includes an electric motor (not illustrated) for the defibrator 30 and rotationally drives the defibrating blade via a driving belt 389.

Figure 3:
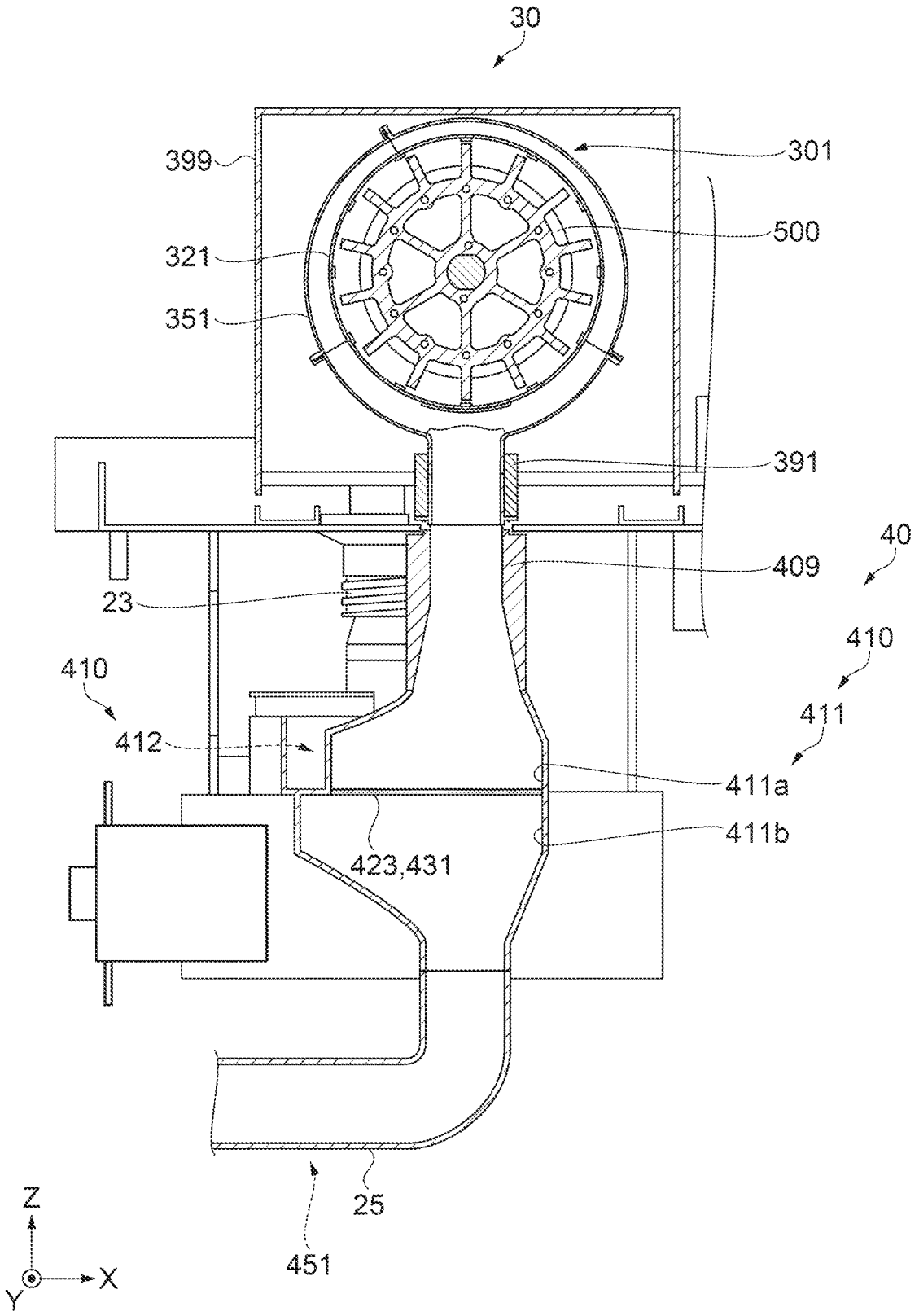
FIG. 3 is a sectional view illustrating a schematic configuration of the defibrator and the separator.

As illustrated in FIG. 3, the defibrator 30 includes the main body 301 and a discharge duct 391. The main body 301 includes a defibrating blade 500, a housing portion 351, and a screen member 321. The screen member 321 covers the defibrating blade 500, and the housing portion 351 covers the screen member 321.

The defibrator 30 defibrates the used paper C, which is a material containing fibers, with the defibrating blade 500 to form a defibrated material containing fibers.

The discharge duct 391 is disposed below the defibrating blade 500. The discharge duct 391 projects downward from the main body 301 of the defibrator 30. The defibrated material is discharged from the discharge duct 391 to the separator 40 below. Since the discharge duct 391 projects downward, gravity can be used to discharge the defibrated material from the discharge duct 391.

The separator 40 includes an introduction duct 409, a housing 410, a rotary member 423, and a separation filter 431. The separator 40 separates and extracts fibers, which are raw materials of the sheet P3, from the defibrated material using the rotary member 423 and the separation filter 431.

A first separation chamber 411 including a front portion 411*a* and a rear portion 411*b*, and a second separation chamber 412 are provided in the housing 410. In the housing 410, the first separation chamber 411 is disposed substantially in the +Y direction, and the second separation chamber 412 is disposed substantially in the −Y direction. The pipe 25 and the airflow pipe 451 are disposed below the housing 410.

The introduction duct 409 of the separator 40 projects upward from the housing 410 of the separator 40. An upper end of the introduction duct 409 and a lower end of the discharge duct 391 of the defibrator 30 are disposed to face each other in a direction along the Z axis. An upper portion of the introduction duct 409 is in communication with an inside of the discharge duct 391, and a lower portion of the introduction duct 409 is in communication with the first separation chamber 411 of the housing 410. Therefore, the flow of the defibrated material from the discharge duct 391 to the introduction duct 409 becomes smoother, and retention of fibers and the like can be further suppressed.

The first separation chamber 411 includes the front portion 411*a* and the rear portion 411*b*. The front portion 411*a* and the rear portion 411*b* are arranged in a direction along the Z axis. The front portion 411*a* is disposed above the rear portion 411*b*. The rotary member 423 and the separation filter 431 are installed at a boundary between the front portion 411*a* and the rear portion 411*b*.

In the separator 40, the defibrated material is introduced from the introduction duct 409 to the front portion 411*a* of the first separation chamber 411. The introduction duct 409 is disposed above the rotary member 423 and the separation filter 431. As a result, gravity can be used to introduce the defibrated material from the introduction duct 409 to the front portion 411*a*.

The pipe 25 is coupled to a lower portion of the rear portion 411*b*. The rear portion 411*b* is in communication with an inside of the pipe 25. The airflow pipe 451 is disposed in the −Y direction of the pipe 25. An inside of the airflow pipe 451 is in communication with an inside of the second separation chamber 412.

Figure 4:
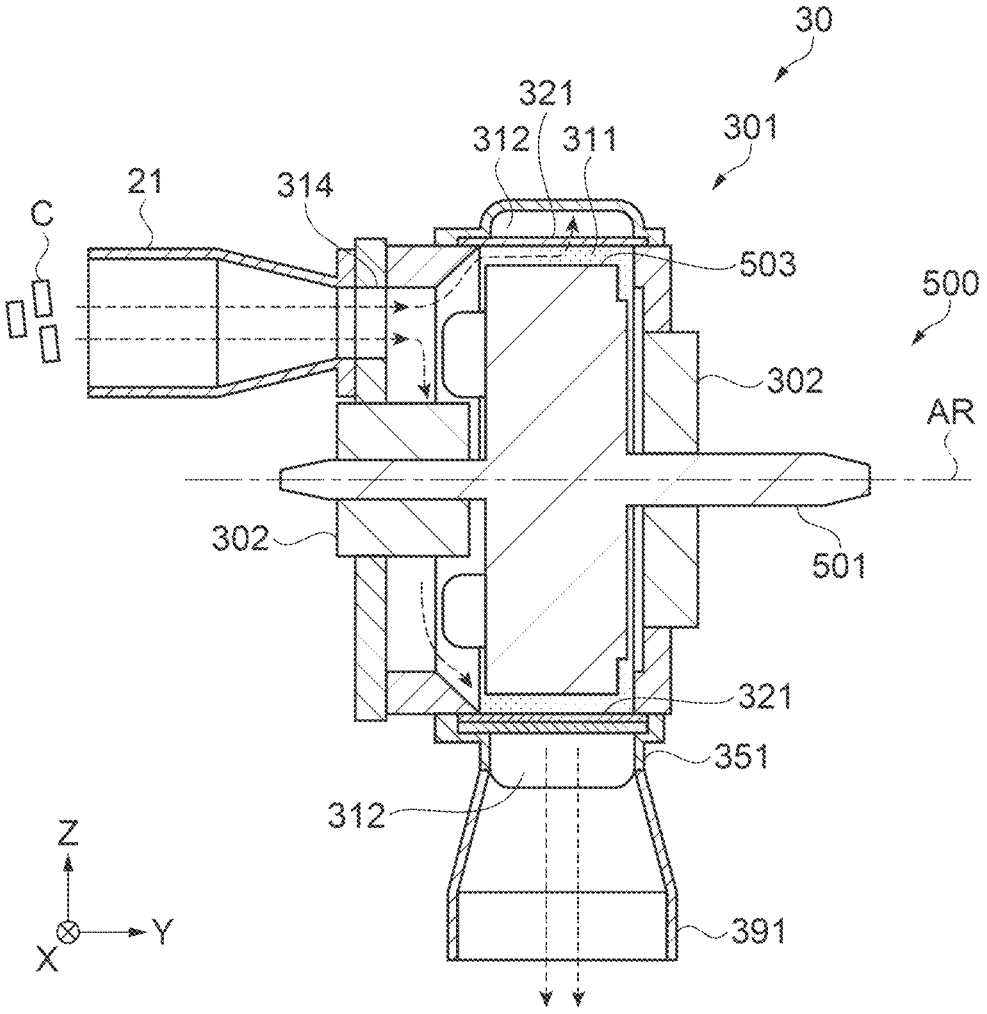
FIG. 4 is a sectional view illustrating a detailed configuration of the defibrator.

As illustrated in FIG. 4, in the main body 301 of the defibrator 30, the pipe 21 is coupled to an upper side in the −Y direction. The used paper C is introduced into a defibrating chamber 311 inside the screen member 321 from the pipe 21 via a supply port 314.

The defibrating blade 500 includes a rotary blade 503 and a rotary shaft 501. The rotary shaft 501 is a shaft member extending along the Y axis. The defibrating blade 500 has a rotationally symmetrical shape with respect to a central axis AR of the rotary shaft 501. The central axis AR also extends along the Y axis.

The rotary blade 503 is accommodated in the defibrating chamber 311. The rotary shaft 501 projects from the defibrating chamber 311 in the +Y direction and the −Y direction. The +Y direction and the −Y direction of the rotary shaft 501 are rotatably supported by corresponding bearing portions 302.

The rotary blade 503 is driven by the above-described drive unit 387 and rotates around the central axis AR in the defibrating chamber 311. By the rotation of the rotary blade 503, the used paper C is shredded by a dry type method and defibrated into a defibrated material containing fibers.

A collection chamber 312 is disposed while surround the defibrating chamber 311. The collection chamber 312 is a space surrounded by the screen member 321 and the housing portion 351.

Figure 5:
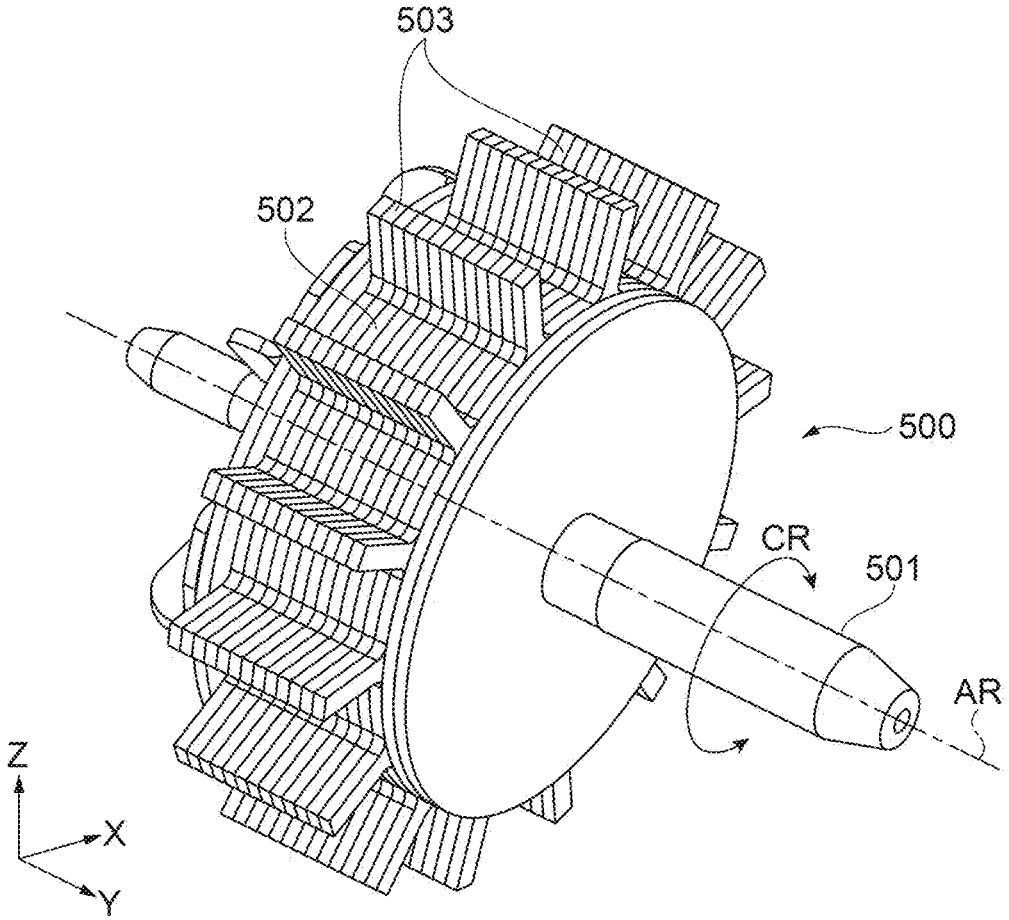

As illustrated in FIG. 5, the defibrating blade 500 includes a base portion 502 in addition to the rotary shaft 501 and the rotary blade 503 that are described above. The base portion 502 is a substantially columnar member, and a height direction of the column extends along the Y axis. The rotary blade 503 is composed of a plurality of blades radially projecting from the base portion 502 in a side view in the +Y direction. The defibrating blade 500 rotates around the central axis AR in a rotation direction CR.

Figure 6:
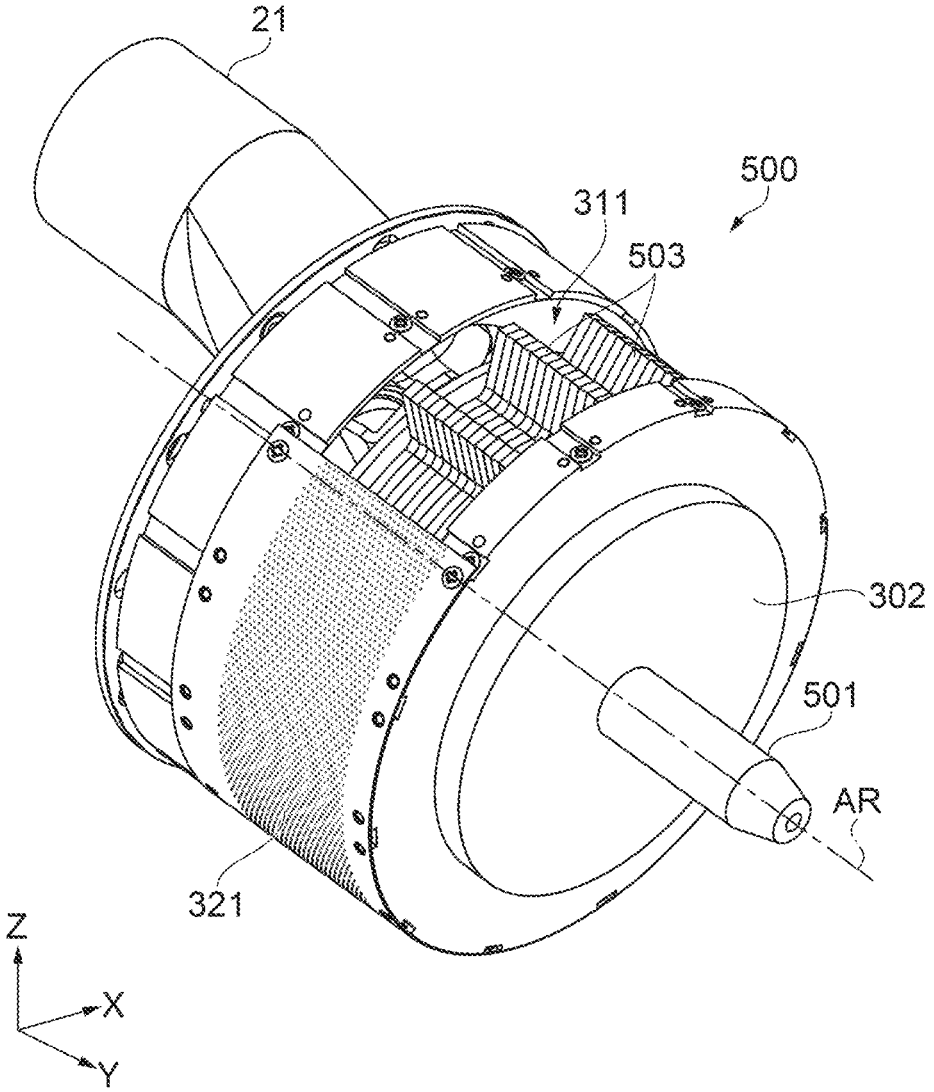
FIG. 6 is a perspective view illustrating an arrangement of a defibrating chamber and a screen member.

As illustrated in FIG. 6, the screen member 321 is disposed so as to cover a plurality of the rotary blades 503. In FIG. 6, a part of the screen member 321 is omitted.

The used paper C contains cellulose fibers. In the defibrating chamber 311, the used paper C is formed into small pieces by rotation of the rotary blades 503, and the small pieces are further formed into a defibrated material containing fibers.

The screen member 321 is provided with a plurality of holes in a region corresponding to the rotary blades 503. Each of the plurality of holes described above allows fibers generated by defibration of the used paper C to pass therethrough, and does not allow small pieces of the used paper C in the middle of being defibrated or entangled fibers to pass therethrough.

Figure 7:
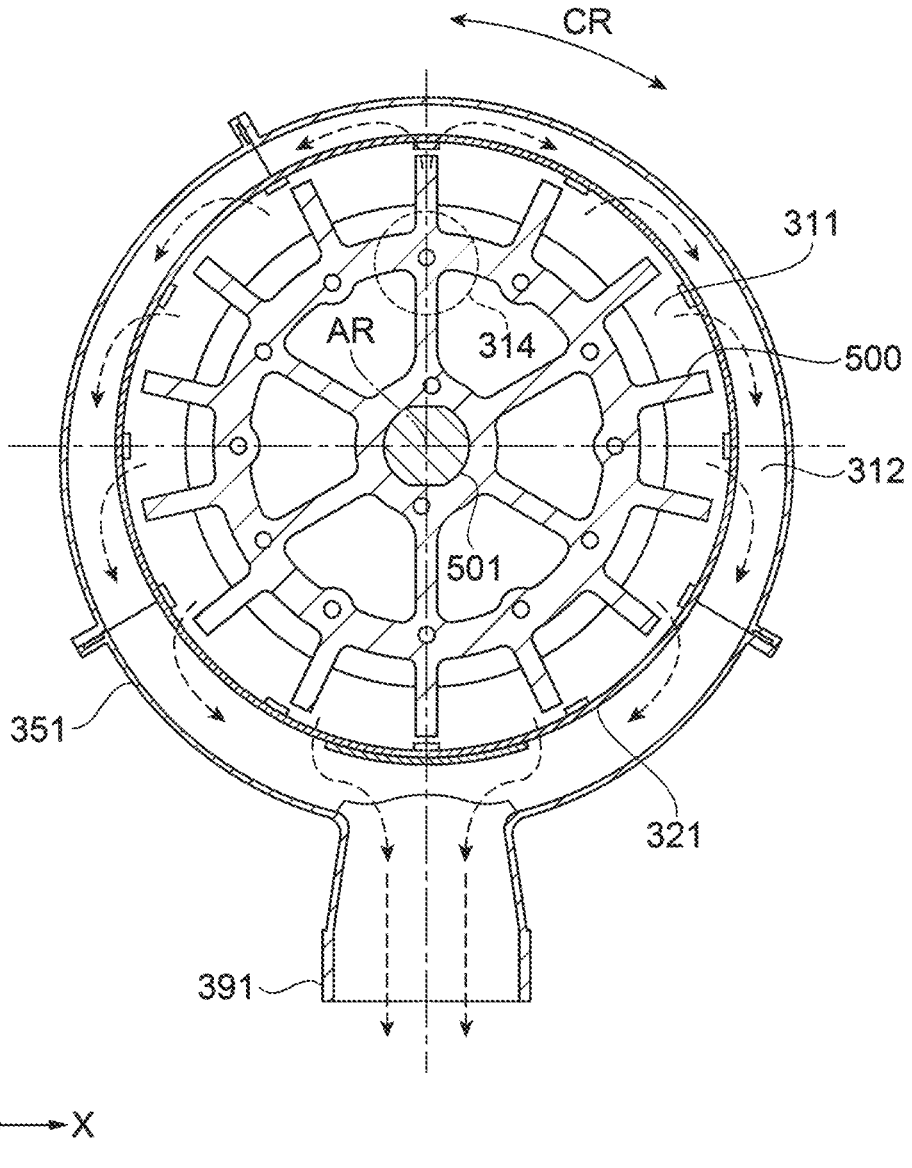
FIG. 7 is a sectional view illustrating a flow of used paper and defibrated fibers.

As illustrated in FIG. 7, in a side view in the +Y direction, the screen member 321 covers an outside of the defibrating blade 500, and the housing portion 351 covers an outside of the screen member 321. In FIG. 7, a flow of the defibrated material produced from the used paper C is indicated by dashed arrows. In addition, in the following description of FIG. 7, a state viewed in the +Y direction will be described unless otherwise specified.

The screen member 321 is circular, and the housing portion 351 is substantially circular. The discharge duct 391 is coupled to a lower portion of the housing portion 351.

The center of the screen member 321 substantially coincides with the central axis AR of the defibrating blade 500. The position corresponding to the center of the housing portion 351 is offset slightly downward with respect to the central axis AR. A space of the collection chamber 312 is narrow on an upper side and wide on a lower side.

The used paper C (not illustrated) is introduced into the defibrating chamber 311 from the supply port 314 and is defibrated by the defibrating blade 500 so as to be a defibrated material. The defibrated material passes through the screen member 321 and flows from the defibrating chamber 311 into the collection chamber 312. In the collection chamber 312, the defibrated material moves downward toward the discharge duct 391. Then, the defibrated material is discharged downward from the discharge duct 391.

Figure 8:
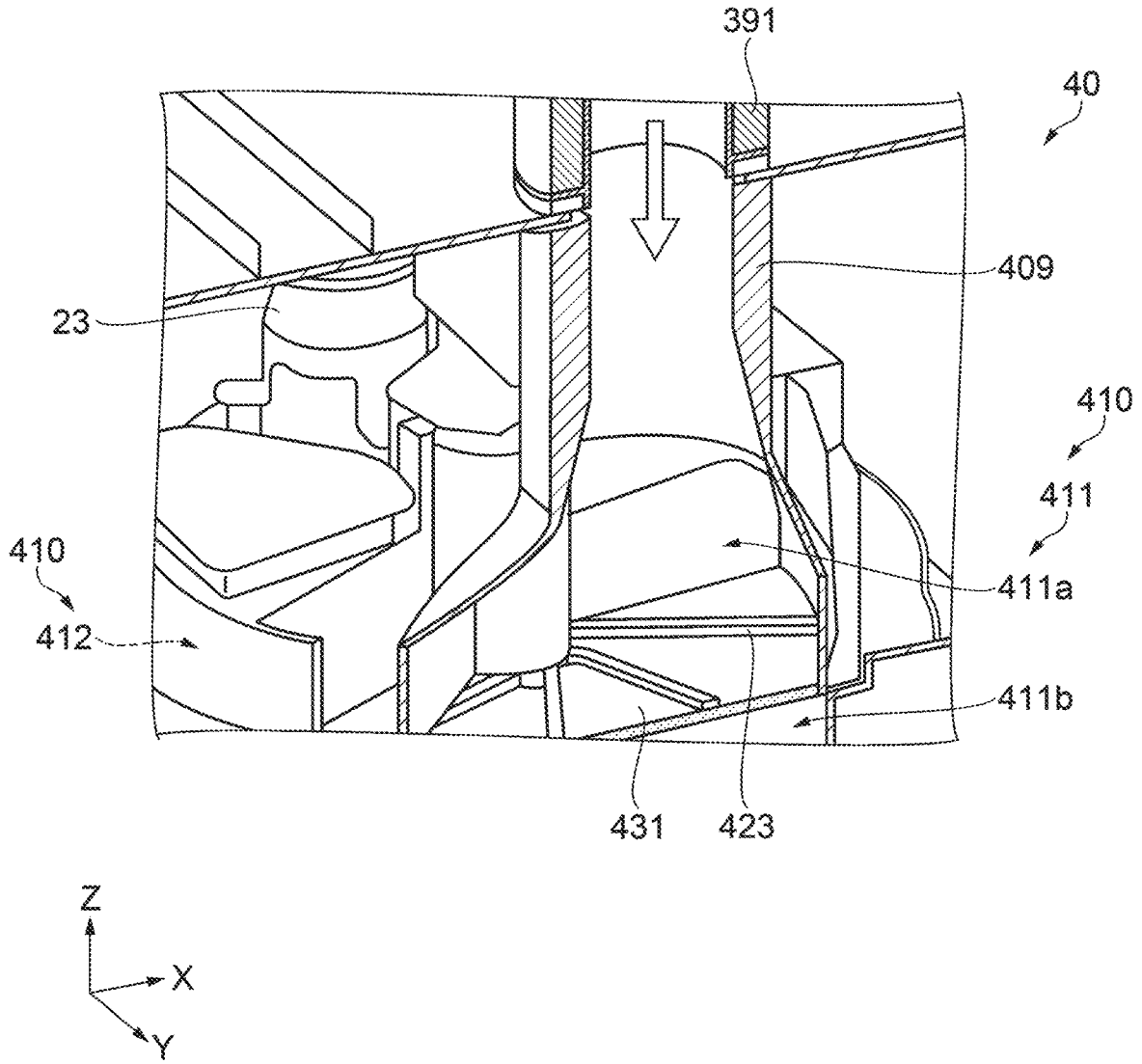
FIG. 8 is a sectional perspective view illustrating an aspect of a first separation chamber.

As illustrated in FIG. 8, the defibrated material is introduced from the discharge duct 391 to the introduction duct 409 as indicated by the white arrow. The introduction duct 409 is in communication with the front portion 411*a* of the first separation chamber 411 located below. The rotary member 423 and the separation filter 431 are installed between the front portion 411*a* and the rear portion 411*b* below the front portion 411*a*.

The rotary member 423 is disposed above the separation filter 431. The defibrated material that has flowed into the front portion 411*a* is temporarily blocked by the separation filter 431. The above-described pipe 25 is disposed below the rear portion 411*b*. Although not illustrated, the pipe 25 is provided with a suction mechanism for sucking air from the discharge duct 391 to the rear portion 411*b*. As a result, the air in the discharge duct 391 and the front portion 411*a* is sucked into the rear portion 411*b*.

The separation filter 431 is a mesh member having a substantially circular shape in plan view from above. The separation filter 431 is fixed to the rotary member 423. The rotary member 423 has a substantially circular outer shape in plan view from above. The rotary member 423 is disposed in the housing 410 so as to be rotatable together with the separation filter 431.

The second separation chamber 412 is disposed substantially in the −Y direction of the first separation chamber 411. The rotary member 423 and the separation filter 431 are exposed to an inside of the first separation chamber 411 and are also exposed to the inside of the second separation chamber 412. The rotary member 423 is driven by an electric motor (not illustrated) for the separator 40 to rotate between a region exposed to the first separation chamber 411 and a region exposed to the second separation chamber 412.

Figure 9:
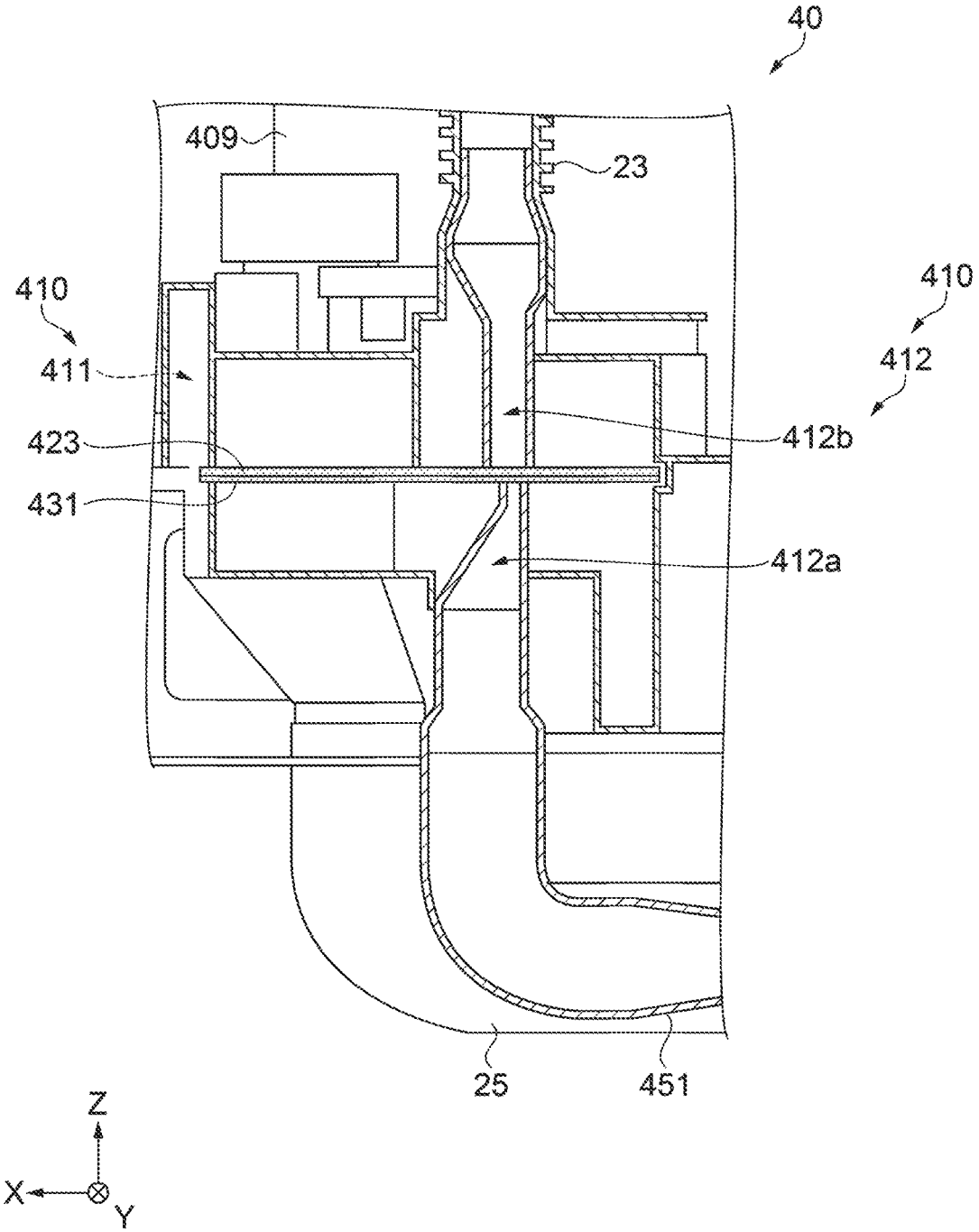
FIG. 9 is a sectional view illustrating an aspect of a second separation chamber.

As illustrated in FIG. 9, in the second separation chamber 412, a front portion 412*a* is disposed above the airflow pipe 451, and a rear portion 412*b* is disposed above the front portion 412*a*. The rotary member 423 and the separation filter 431 are installed between the front portion 412*a* and the rear portion 412*b*.

The airflow pipe 451 is in communication with an inside of the front portion 412*a*. A blower (not illustrated) is disposed in an end portion of the airflow pipe 451. The above-described blower blows an airflow into the front portion 412*a* via the airflow pipe 451. The airflow passes through the separation filter 431, flows to the rear portion 412*b*, and further flows downstream from the pipe 23.

Figure 10:
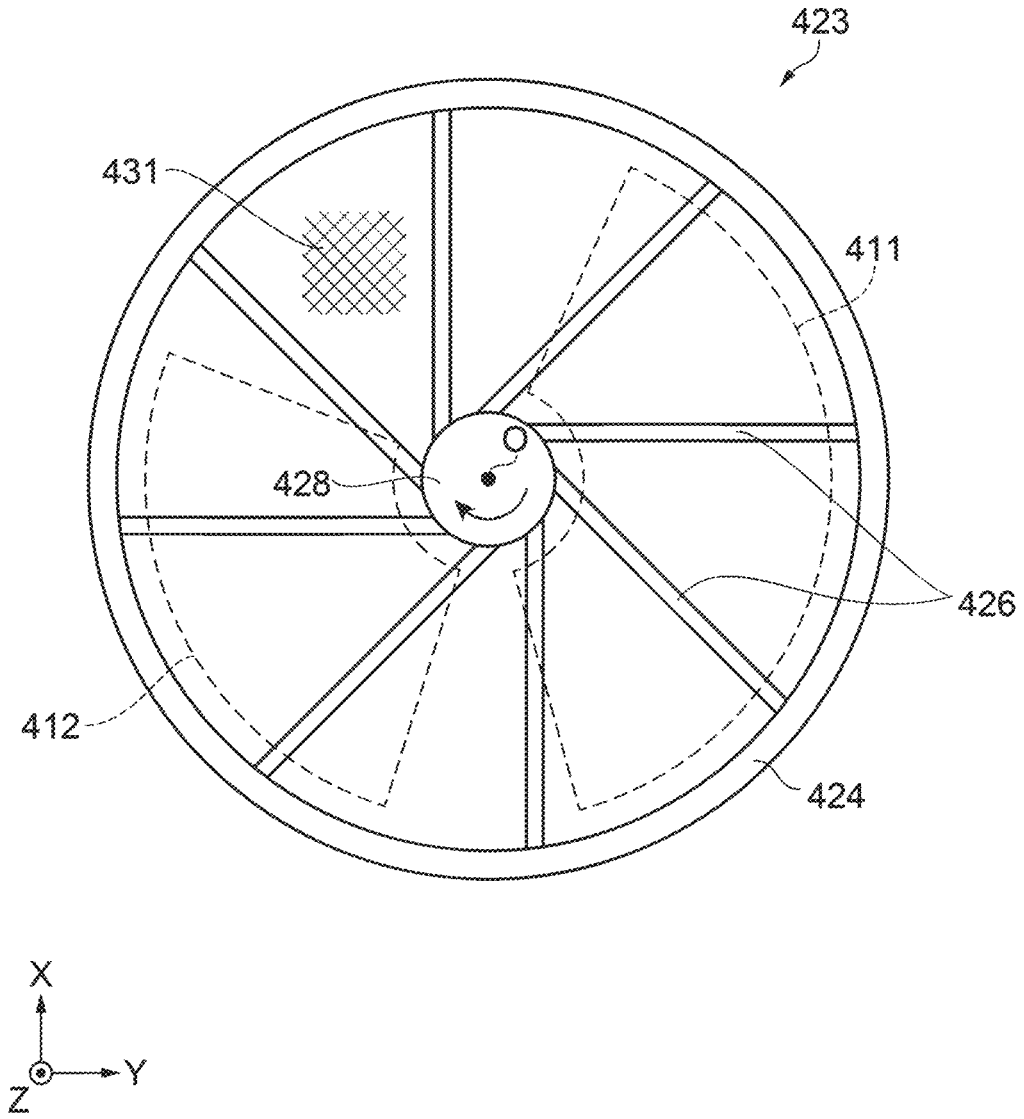
FIG. 10 is a plan view illustrating an arrangement of the first separation chamber and the second separation chamber with respect to a rotary member.

As illustrated in FIG. 10, the rotary member 423 includes an outer frame portion 424, a spoke portion 426, and an inner shaft portion 428. In FIG. 10, in addition to the rotary member 423, the separation filter 431, the first separation chamber 411, and the second separation chamber 412 are also illustrated. In FIG. 10, regions corresponding to the first separation chamber 411 and the second separation chamber 412 are indicated by broken lines.

In plan view from above, the inner shaft portion 428 has a circular shape, and the outer frame portion 424 has a circular ring shape. The outer frame portion 424 is supported via eight spoke portions 426 with respect to the inner shaft portion 428. The rotary member 423 rotates around a rotation center O by being driven by the above-described electric motor. The spoke portions 426 of the rotary member 423 and the separation filter 431 are rotated by rotation of the rotary member 423.

The defibrated material introduced into the first separation chamber 411 is blocked on a surface of the separation filter 431 in the +Z direction. Then, the blocked defibrated material moves together with the spoke portions 426 of the rotary member 423. At this time, short fibers, particulate contaminants, and the like in the defibrated material pass through the separation filter 431 by suction of the above-described suction mechanism, and are sucked to the rear portion 411*b* (not illustrated) and removed.

On the other hand, long fibers in the defibrated material that do not pass through the separation filter 431 move to the second separation chamber 412 while remaining on the upper surface of the separation filter 431 by rotation of the rotary member 423.

As described above, in the second separation chamber 412, an airflow derived from the blower, which flows from the front portion 412*a* to the pipe 23 via the rear portion 412*b*, is generated. The long fibers in the defibrated material are blown up from above the separation filter 431 to an upper side of the rear portion 412*b* by the airflow, and are transported downstream from the pipe 23. As described above, the fibers used as the material of the sheet P3 are sorted from other unnecessary components.

Figure 11:
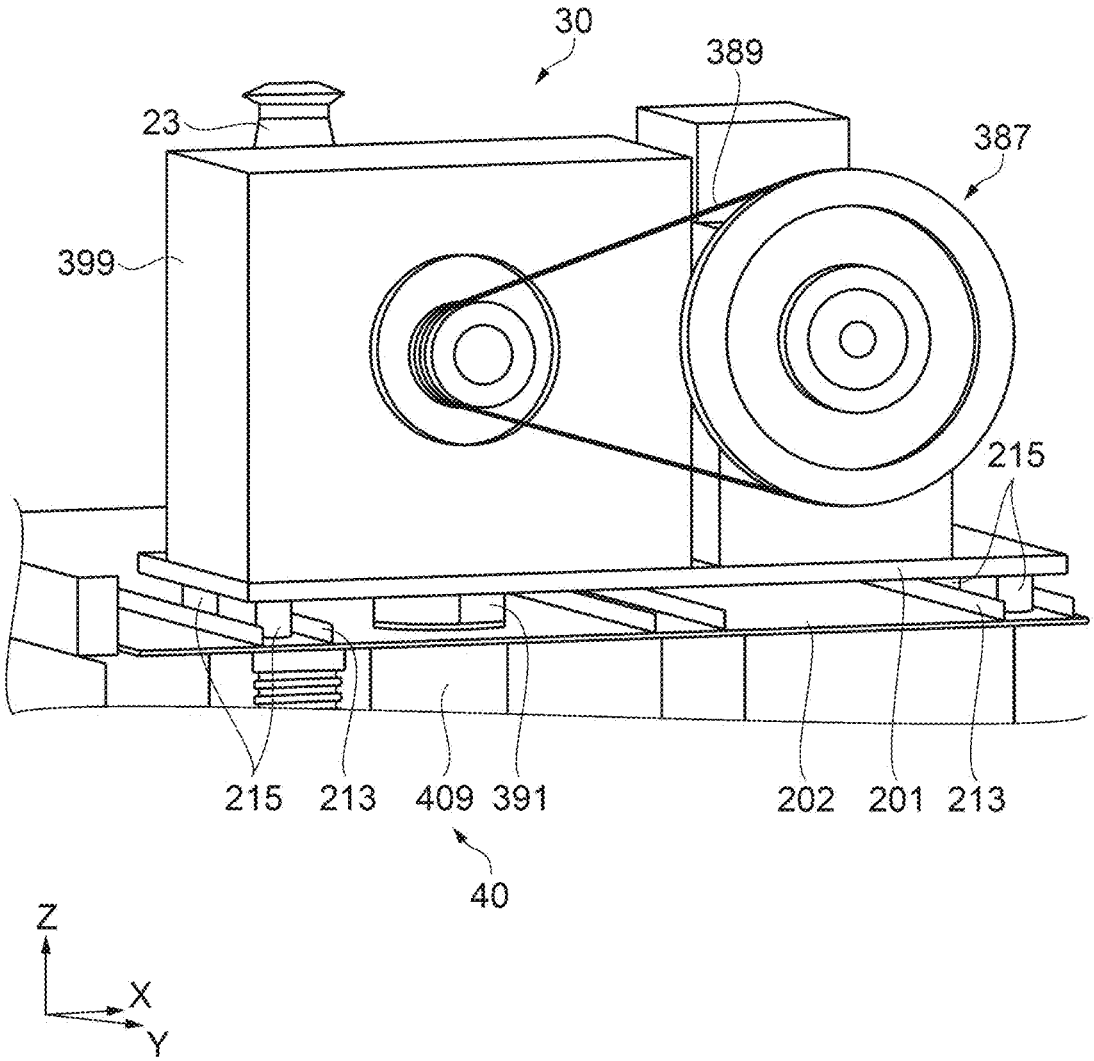
FIG. 11 is a perspective view illustrating an arrangement of a first plate, a second plate, and a buffer member.

As illustrated in FIG. 11, in the defibrator 30, since the above-described defibrating blade 500 is rotationally driven by the drive unit 387, vibration is likely to occur. In the sheet manufacturing apparatus 1, a distance between the discharge duct 391 and the introduction duct 409 is short, and a flexible pipe or the like is not interposed therebetween. Therefore, the vibration of the defibrator 30 is easily propagated to the separator 40. On the other hand, in the sheet manufacturing apparatus 1, propagation of the vibration to the separator 40 is suppressed by the configuration described below.

The sheet manufacturing apparatus 1 includes a first plate 201 and a second plate 202. The first plate 201 and the second plate 202 are both substantially rectangular plate-like members, and main surfaces thereof extend along an XY plane. Between the defibrator 30 and the separator 40, the first plate 201 is disposed on an upper side on the defibrator 30 side, and the second plate 202 is disposed on a lower side on the separator 40 side.

The drive unit 387 and the exterior 399 of the defibrator 30 are mounted on and fixed to an upper surface of the first plate 201. On a lower surface of the second plate 202, the introduction duct 409 of the separator 40 is supported. Although not illustrated, the housing 410 of the separator 40 is fixed to the second plate 202 via a sub frame or the like.

The first plate 201 is not fixed to a frame of the second unit group 102, and is supported by the second plate 202 via four buffer members 215. The second plate 202 is supported by the above-described frame of the second unit group 102 via a member (not illustrated).

Two supporting members 213 are fixed to the second plate 202. Each supporting member 213 is not fixed to the respective two buffer members 215. An upper portion of each of the four buffer members 215 is fixed to the first plate 201, and a lower portion thereof is fixed to the second plate 202. As a result, the first plate 201 and the second plate 202 are coupled to each other via the four buffer members 215.

Each buffer member 215 has a thickness in a direction along the Z axis, is formed of an elastic body such as rubber, and attenuates the vibration generated from the defibrator 30. The above-described thickness of the buffer member 215 is not particularly limited, but is, for example, approximately 30 mm. The supporting member 213 is an elongated rail-shaped member extending along the Y axis, and is made of, for example, a metal plate by sheet metal processing.

Figure 12:
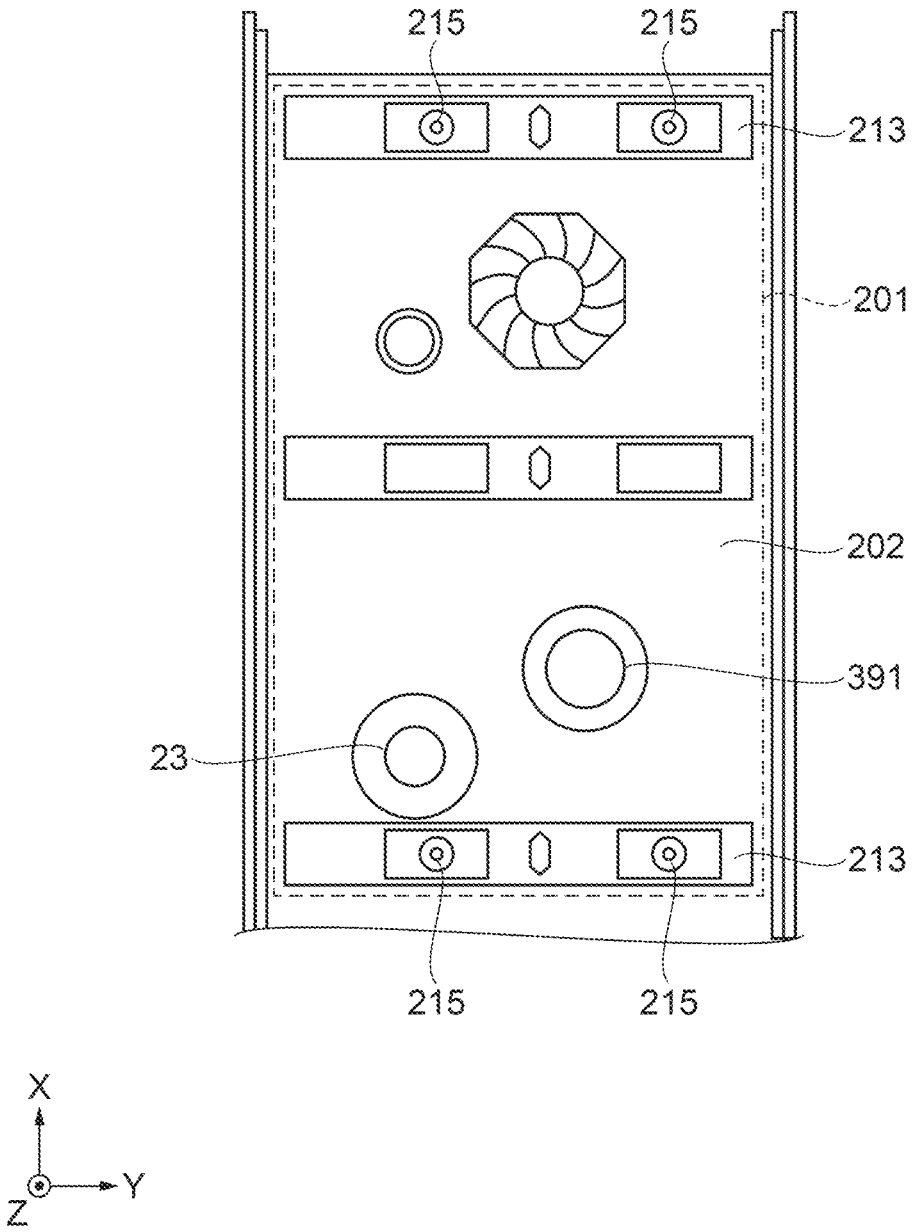
FIG. 12 is a plan perspective view illustrating a disposition of the buffer member.

As illustrated in FIG. 12, the two supporting members 213 are arranged along the Y axis. In FIG. 12, the first plate 201 is indicated by a broken line.

Specifically, the supporting members 213 are disposed so as to correspond to two short sides of the first plate 201. Respective two buffer members 215, of the four buffer members 215, are arranged along the X axis on each supporting member 213.

With the above-described configuration, propagation of the vibration generated from the defibrator 30 to the separator 40 is suppressed. As a result, an influence of the vibration on the separator 40 is suppressed, and the defibrated material sorting accuracy of the separator 40 is improved. The number, form, and arrangement of the buffer members 215 and the supporting members 213 are not limited to those described above.

Figure 13:
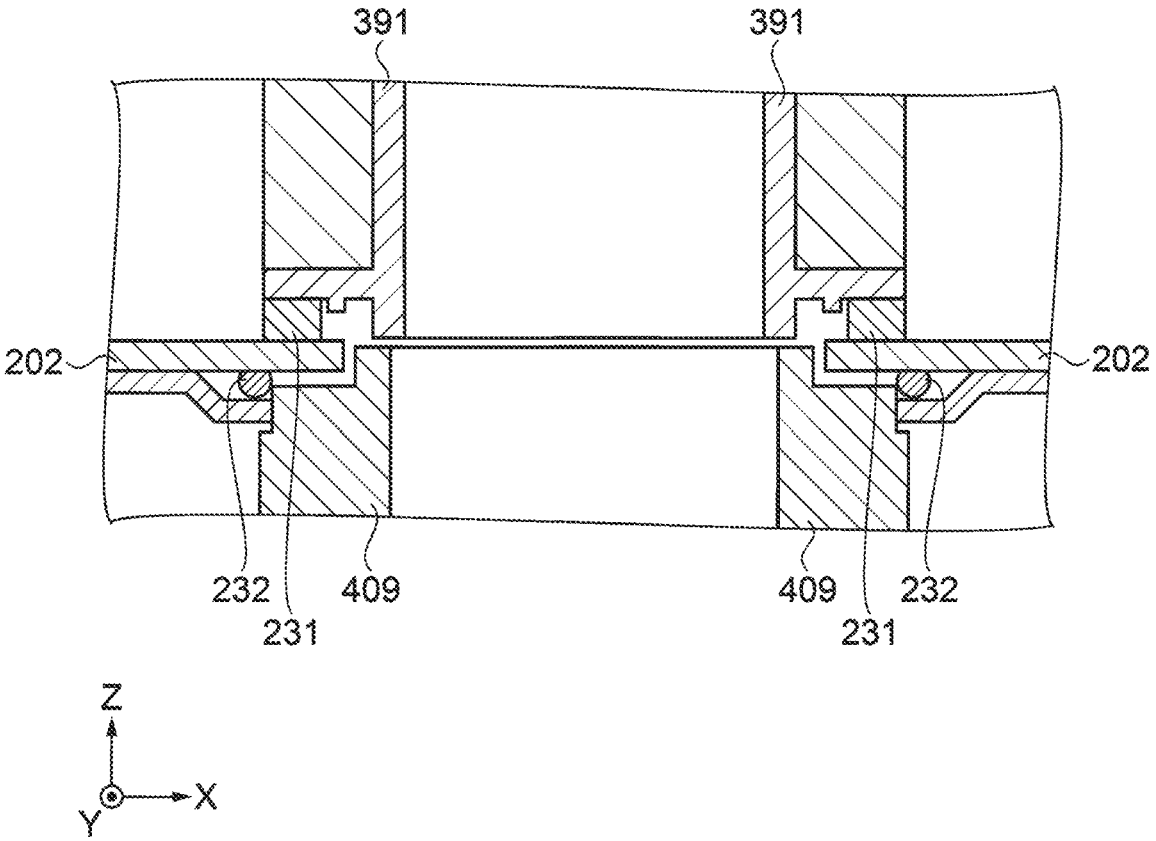
FIG. 13 is an enlarged sectional view illustrating an arrangement of a first gasket and a second gasket.

As illustrated in FIG. 13, a first gasket 231 is disposed between the discharge duct 391 and the second plate 202. A second gasket 232 is disposed between the second plate 202 and the introduction duct 409.

The first gasket 231 and the second gasket 232 are ring-shaped members in plan view from above. The first gasket 231 has a substantially rectangular cross-sectional shape, and the second gasket 232 has a substantially circular cross-sectional shape. The cross-sectional shapes of the first gasket 231 and the second gasket 232 are not limited to the above-described shapes, and may be, for example, a substantially circular shape, a substantially rectangular shape, a polygonal shape, an elliptical shape, or an irregular shape.

The first gasket 231 and the second gasket 232 are formed of a material having elasticity such as rubber. The defibrated material flowing through the discharge duct 391 and the introduction duct 409 may be moist by humidification. Therefore, it is preferable to use a hardly hydrolyzable material for the first gasket 231 and the second gasket 232.

The discharge duct 391 is not fixed to the second plate 202. The defibrator 30 is supported by the second plate 202 via the first plate 201, the four buffer members 215, and the like. Therefore, an edge of the lower end of the discharge duct 391 is pressed downward against the first gasket 231.

The introduction duct 409 is also not fixed to the second plate 202. As described above, the housing 410 of the separator 40 is fixed to the second plate 202 via a sub frame or the like. An edge of the upper end of the introduction duct 409 is pressed upward against the second gasket 232.

Figure 14:
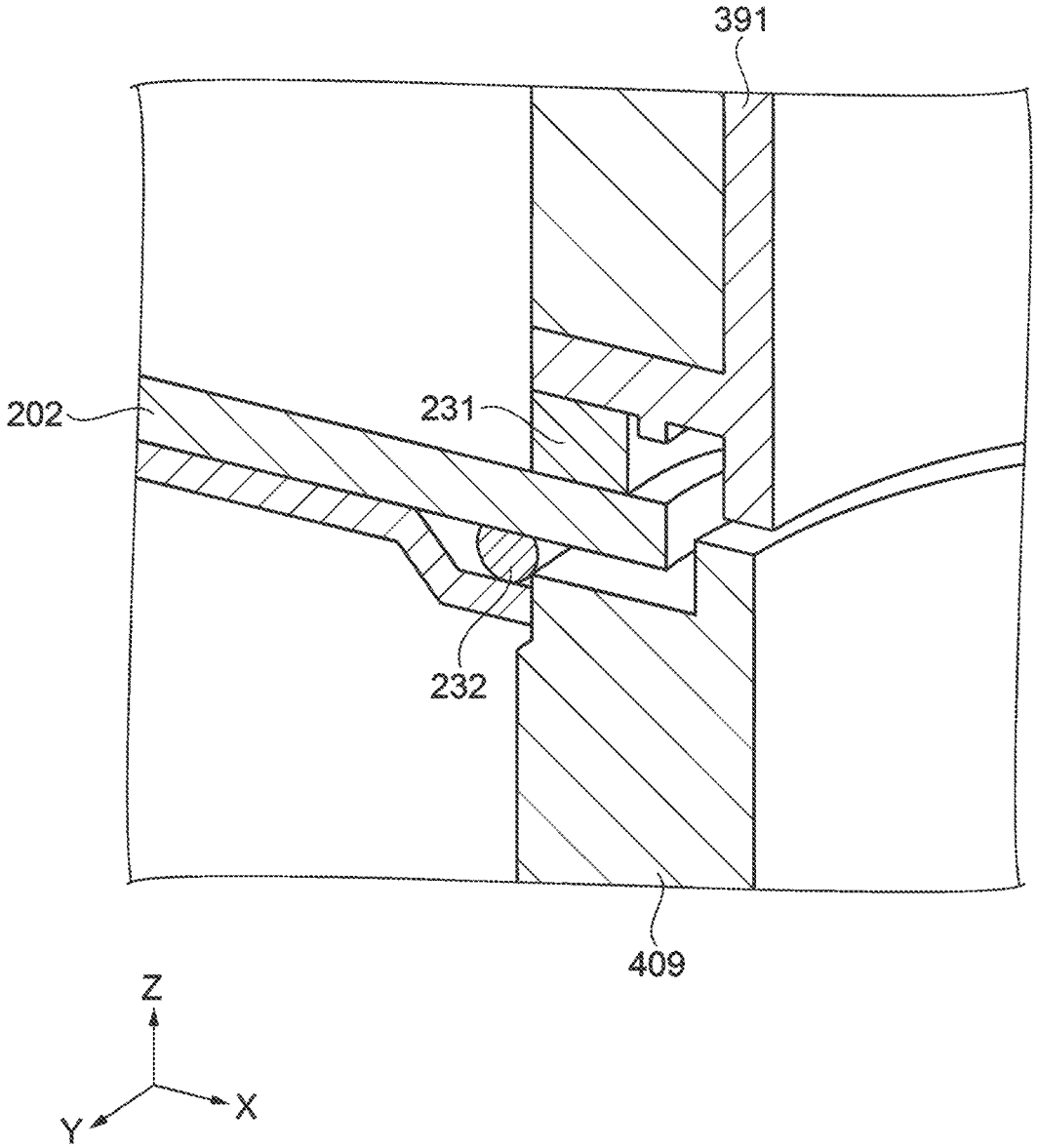
FIG. 14 is a schematic sectional view illustrating an airtight structure between a discharge duct and an introduction duct.

As illustrated in FIG. 14, the discharge duct 391 and the introduction duct 409 are not in contact with each other. Since the discharge duct 391 is pressed downward, the first gasket 231 is slightly crushed and deformed between the discharge duct 391 and the second plate 202. Since the introduction duct 409 is pressed upward, the second gasket 232 is slightly crushed and deformed between the introduction duct 409 and the second plate 202.

The first gasket 231 and the second gasket 232 maintain airtightness between the discharge duct 391 and the introduction duct 409. As a result, flowing out of fibers and the like is suppressed in an internal path for the defibrated material from the defibrator 30 to the separator 40. In addition, propagation of the vibration of the defibrator 30 to the separator 40 via the discharge duct 391 and the introduction duct 409 is suppressed.

According to the present embodiment, the following effects can be obtained.

Retention of fibers and the like can be suppressed between the defibrator 30 and the separator 40. Specifically, the separator 40 is disposed directly below the defibrator 30, and a leading end of the introduction duct 409 faces a leading end of the discharge duct 391. That is, since the discharge duct 391 of the defibrator 30 and the introduction duct 409 of the separator 40 are disposed close to each other, a relatively long and curved pipe, such as a flexible pipe, is not necessary between the defibrator 30 and the separator 40. As a result, the step in the internal path between the defibrator 30 and the separator 40 is eliminated. Therefore, it is possible to provide the sheet manufacturing apparatus 1 which suppresses retention of fibers and the like.

What is claimed is:

1. A sheet manufacturing apparatus that manufactures a sheet from a material containing a fiber, the sheet manufacturing apparatus comprising:

a defibrator that includes a defibrating blade and a discharge duct, defibrates the material with the defibrating blade, and discharges a defibrated material containing the fiber from the discharge duct;

a separator that is a disk type, includes an introduction duct and a separation filter, receives the defibrated material from the introduction duct, and separates and extracts the fiber from the defibrated material with the separation filter;

an accumulation unit that causes the fiber supplied from the separator to accumulate by an airflow to form a web; and a sheet forming unit that compresses the web to form the sheet, wherein the separator is disposed directly below the defibrator, and a leading end of the introduction duct of the separator is disposed to face a leading end of the discharge duct of the defibrator.

2. The sheet manufacturing apparatus according to claim 1, further comprising:

a first plate to which the defibrator is fixed; and a second plate on which the separator is supported, wherein a buffer member is disposed between the first plate and the second plate, and the first plate and the second plate are coupled via the buffer member.

3. The sheet manufacturing apparatus according to claim 2, wherein a first gasket is disposed between the discharge duct and the second plate, a second gasket is disposed between the second plate and the introduction duct, and airtightness between the discharge duct and the introduction duct is maintained by the first gasket and the second gasket.

4. The sheet manufacturing apparatus according to claim 1, wherein the discharge duct of the defibrator is disposed below the defibrating blade and projects downward from a main body of the defibrator.

5. The sheet manufacturing apparatus according to claim 4, wherein the introduction duct of the separator is disposed above the separation filter and projects upward from a housing of the separator.

* * * * *